United States Patent [19]

Ashie et al.

[11] 4,241,143

[45] Dec. 23, 1980

[54] PROCESS FOR PRODUCING HIGHLY GLOSSY COATED PAPER

[75] Inventors: Yutaka Ashie; Yasuhiro Nakamura, both of Tokyo, Japan

[73] Assignee: Mitsubishi Paper Mills, Ltd., Tokyo, Japan

[21] Appl. No.: 20,953

[22] Filed: Mar. 13, 1979

[30] Foreign Application Priority Data

Mar. 17, 1978 [JP] Japan ..... 53-30830

[51] Int. Cl.[3] ..... B05D 3/02; B05D 3/12; B32B 23/08; B32B 27/10

[52] U.S. Cl. ..... 428/512; 260/29.6 R; 427/361; 427/362; 427/365; 427/366; 427/391; 428/514; 428/537

[58] Field of Search ..... 427/361, 365, 366, 391, 427/362; 428/512, 514, 537; 260/29.6 R

[56] References Cited

U.S. PATENT DOCUMENTS

| | | | |
|---|---|---|---|
| 3,578,493 | 5/1971 | Smith | 427/391 X |
| 3,583,881 | 6/1971 | Kennedy | 427/391 X |
| 3,873,345 | 3/1975 | Vreeland | 427/361 |
| 4,012,543 | 3/1977 | Ranger et al. | 427/366 X |

*Primary Examiner*—Michael R. Lusignan

*Attorney, Agent, or Firm*—Cushman, Darby & Cushman

[57] ABSTRACT

A cast coated paper which has the 20° reflection gloss of 15% or more and good ink receptivity is produced by applying to a paper an aqueous coating color containing satin white in an amount of 5 to 40 parts by weight based on 100 parts by weight of pigments including the satin white, and a polymer latex having a Tg more than 45° C. in an amount of 5 to 40 parts by weight of 100 parts by weight of the pigments including the satin white.

14 Claims, No Drawings

PROCESS FOR PRODUCING HIGHLY GLOSSY COATED PAPER

The present invention relates to a process for producing highly glossy coated paper having excellent gloss with a high production rate.

High grade coated paper generally called "art paper" is produced by applying an aqueous coating color containing pigments and thermoplastic polymer emulsions to base paper, drying the coated paper web, and then allowing the paper to pass through a gloss finishing and smoothing means such as a supercalender, gloss calender or brushing machine. These gloss finishing and smoothing means can achieve finishing of the paper at a high speed and therefore are very efficient. However, any combination of aqueous coating colors which have been known in the art with said gloss finishing and smoothing means can not produce a highly glossy coated paper which is called "cast coated paper" having a gloss of at least 15%. The gloss as above and herein expressed is a ratio (%) of a light regularly reflected by the paper specimen over incident light, where angles of incidency and reflection are each 20° to the normal of the paper specimen. Therefore, a special finishing method must be employed in order to produce the cast coated paper.

Methods for producing the cast coated paper may be classified into a wet casting method (as disclosed in, for example, Japanese Patent Publication No. 25160/63), a rewetting casting method (as disclosed in, for example, U.S. Pat. No. 2,759,847), and a gellation casting method (as disclosed in, for example, Japanese Patent Publication No. 15751/63 or U.S. Pat. No. 3,377,192). Said wet casting method comprises steps of applying an aqueous coating color to paper, pressing the coated substrate in a wet state to a heated finishing surface of a so-called cast drum and drying it. Said rewetting casting method comprises steps of drying the coated substrate, wetting it again in order to plasticize its coated layer pressing it to a heated cast drum and drying it. With both of the wet casting and the rewetting casting methods, it is impossible to increase speed of production because a coated substrate is pressed in a fluidized state to the cast drum. Therefore, cast coated paper is now being produced mostly by said gellation casting method.

The gellation casting method comprises steps of gelling of some means a coated substrate to keep it in substantially solid but plastisizable state and pressing it in a wet state to the cast drum. The gellation of the coated substrate is to dip the wet coated substrate into a gelling solution. As this dipping method there are known a heat sensitive gellation method in which a protein, such as casein, contained in an aqueous coating color is gelled by heating (as disclosed in Japanese Patent Publication No. 15751/63) and a heat sensitive gellation method in which satin white contained in an aqueous coating color is solidifed by heating (as disclosed in Japanese Pat. No. Kokai 40410/76).

In producing cast coated paper these gellation casting methods indeed improve the productivity as compared to the wet casting and rewetting casting methods. However, these methods is still much poor in productivity as compared with the method for producing the art paper, in which the gloss finishing and smothing means are used, because the coating substrate contains an appreciable amount of water which retards the speed of finishing when the substrate is pressed in a wet state to the heated cast drum. Additionally, during the finishing moisture in the substrate violently moves through the substrate, and thereby when the substrate is applied onto both sides by a coating color such troubles often occurs, as not only difference of gloss between the both sides but also blister of one side which is caused by the rapid immigration of water vapor from one side to another. Accordingly, a highly glossy coated paper finished on both sides is difficult to prepare by the casting methods as mentioned above.

It is an object of the present invention to reduce the defects as mentioned above and provide a process for preparing a high gloss coated paper in high productivity comparable to that of the methods for producing the art paper.

It is another object of the invention to produce a high gloss coated paper having the gloss on both sides without any troubles.

According to the present invention, there is provided a process for producing a high gloss coated paper comprising applying to paper an aqueous coating color containing 5 to 40 parts by weight of satin white per 100 parts by weight of total pigments and 5 to 40 parts by weight of a polymer latex having a Tg more than 45° C. per 100 parts by weight of total pigments, drying and subjecting the dried coated substrate to specular finishing at a temperature higher than Tg of the polymer latex.

According to the present invention, it is not necessary to gel the coated substrate. Therefore, pH control of the gelling liquor as well as strict adjustment of a drying temperature are not required. Furthermore, destruction of a coated layer by water vapor is eliminated because the coated substrate is finished in a dry state through a heated calender. Thus, a stable operation with good productivity and less troubles is materialized in a production unit similar to that for the art paper.

A coating liquid used in accordance with the present invention contains as binder a polymeric latex having a Tg (glass transition temperature) of higher than 45° C. The purpose therefor is that a very high level of gloss is provided by maintaining the temperature of the coated substrate not higher than the Tg during the drying in order to avoid coalescence of the binder, and thereafter passing the coated substrate through a heated calender of which temperature is raised to higher than the Tg of the polymer latex used.

The polymer latex is used in an amount of 5–40 parts by weight per 100 parts by weight of total pigment used. If the amount is less than 5 parts by weight, the gloss required is not obtained. If the polymer latex is used in an amount of more than 40 parts, the resulting coated substrate becomes sticky to the heated calender, rendering often some troubles, and poor ink absorption and ink receptivity of the product. Particularly, the polymeric latex is used preferably in an amount of 15–30 parts by weight per 100 parts by weight of total pigments with respect to the compativility with printing and the impartability of gloss.

As the polymer latex used in the present invention, the one having Tg higher than 45° C. should be made use of. For example, polyvinyl acetate latex, styrene-isoprene copolymer latex, styrene-butadiene latex and acrylic polymer latex may be used.

The reason why the specific pigment, satin white is essential in pigments used in the present is that it imparts a high reflection gloss at 20° or so-called "shiness". The use of the polymer latex having a high Tg makes it possible, even without satin white, to impart approximately the same reflection 75° gloss as that of the high grade coated paper, but no high reflection 20° gloss can be obtained and, therefore, a poor "shiness" is obtained as compared with prior art cast coated paper.

According to the present invention it has been found that the "shiness" is improved by incorporating the satin white with other pigments. The function of the satin white is not definitely known, but it appears that the satin white provides a more bulky coated layer than other pigments, so that the bulky coated layer can be contacted in a greater contact area with a heated calender having a specular roll or cylinder when it is pressed on said heated calender. The satin white is used in an amount of 5–40 parts by weight per 100 parts by weight of the total pigments used. If less than 5 parts by weight of satin white is used, then the "shiness" develops only insufficiently. If more than 40 parts by weight of satin white is used, then the "shiness" is also reduced. In order to let satin white develope the "shiness" sufficiently, its amount used is preferably in the range of 10–20 parts by weight.

According to the present invention, the specular finishing is carried out by a calender having a specular roll or cylinder heated to a temperature exceeding the Tg of said polymer latex, whereby said polymer latex is fused or softened. The thus fused or softened polymer latex is pressed to said calender to impart the gloss. The temperature exceeding Tg is preferably higher than 100° C., particularly in the range of 120°–180° C.

As the pigments other than satin white used according to the present invention any of those used for usual coated paper, such as clay, kaolin, titanium oxide, calcium carbonate, aluminum hydroxide, barium sulfate, or plastic pigment may be used. The satin white comprises reaction products of usual calcium oxide or calcium hydroxide with aluminum sulfate or potash alum. The molar ratio of these reactants may be within the range used in commercially available satin white.

The total amount of satin white used is within the range of 5–40 parts by weight per 100 parts of the total amount of the above-mentioned pigments including satin white.

The polymer latex of the prevent invention which has a Tg higher than 45° C. includes, for example, a conjugated diene polymer latex such as a styrene-butadiene copolymer, styrene-isoprene copolymer, a methylmethacrylate butadiene copolymer, an acrylic polymer latex such as a polymer or copolymer of acrylic ester or methacrylic ester, and a vinyl polymer latex such as polyvinyl acetate or an ethylene-vinyl acetate copolymer. Thus, any thermoplastic synthetic resin emulsion, so long as it has a Tg higher than 45° C., can be used in the present invention. These polymer latices are predominantly used as a binder in the aqueous coating color according to the present invention, but in addition to these latices a small amount of an adhesive usable for usual coated paper, for example, a thermoplastic synthetic resin latex having a Tg lower than 45° C., a synthetic resin adhesive such as polyvinyl alcohol, an olefin-maleic anhydride resin or a melamine resin, a starch such as oxidized starch or modified oxidized starch and a cellulose derivative such as hydroxyethyl cellulose or carboxymethyl cellulose, may be also used for the purpose of improving the surface strength of the resulting product as well as for preventing the blocking or the fold cracking. However, the use of said adhesive in an exessive amount causes reduction of the gloss. While the amount of said adhesive to be used may vary depending upon the purposes it should be such that the gloss is not sacrificed. Said amount is at most 5 parts by weight per 100 parts by weight of the total amount of pigments. In addition to the pigment and the binder there may be used an anti-foaming agent, release agent, fluidity modifier, and coloring agent, as desired.

In the present invention, the application of the coating color may be carried out by whatever means is usually used, for example, a blade coater, air-knife coater, doctor coater, roll coater or gravure coater. The coating color may be applied in a single, double or multiple layers.

The amount of the coating color to be applied to one side of paper is 5–40 g/m$^2$ in terms of solid.

The coated layer is dried in such a manner that the temperature of the layer should be kept lower than the above-mentioned Tg of said polymeric latex. Various drying means such as a gas heater, electric heater, hot-air drying chamber, infrared heater or laser may be used. The coated substrate is dried by any of the above-mentioned means to a range of moisture content of 3–9%.

In the present invention, the calender having a heated specular roll or specular cylinder may be a gloss calender or supercalender which is generally used for the art paper or the high grade coated paper.

Any means for such finishing can be employed so long as they has a capacity to heat the coated substrate to a temperature substantially higher than the Tg of polymer latex by 30° to 130° C., and to press or finish the coated substrate. Since surface temperature and linear pressure of the calender puts limitation on the finishing speed, the one that is able to give a linear pressure of at least 20 kg/cm$^2$, particularly 40–190 kg/cm and a surface temperature of 100°–200° C., particularly 120°–180° C., is preferred.

As mentioned above, the present invention has made it possible to produce highly glossy coated paper with a high production rate. The process of the present invention has no such defect as experienced in the prior arts, i.e., there occurs no destruction of coated layers which makes continuous operation impossible, because much less amount of water is transferred on a heated calender or cast drum. Furthermore, the present invention has made it possible to produce two sides cast coated paper with stability.

The present invention will be illustrated below in some examples but it should be understood that it is not limited to these examples.

In the Examples and Control Examples, reflection gloss is measured according to the method of JIS Z8741 and paper brightness is measured according to JIS P8123. The ink setting is measured by an RI printing tester made by Akira Seisakusho, wherein ink application is adjusted to the same for each sample. The applied ink is transferred to a sheet of paper having brightness of 88% one minute after the application. Brightness as measured by a Hunter Refractomer, of the paper on which the ink was transferred is used as a measure of ink setting.

EXAMPLES 1–3 and CONTROL EXAMPLES 1–2

Three coating colors of the present invention and two controls as shown in TABLE 1 were prepared by using a mixing vessel equipped with a clay disperser and agitator, the formulations in Table 1 being shown on dry basis of the coating colors containing 60% by weight of solid.

The coating liquids were applied by a blade coater onto one side each of sheets of base paper having a basis weight of 88 grs/m$^2$ in such a manner that a solid content was 28 grs/m$^2$, dried by hot air to a moisture content of 5% and then passed for gloss finishing through a gloss calender having six pressure rollers at a linear pressure of 80 kg/cm and a surface temperature of 150° C. The other side of the paper was coated in the same manner. Thus, the two-side finishing was carried out. The resulting coated paper had the gloss as shown in TABLE 2.

Samples from the Examples 1, 2, and 3 all showed uniform and high shiness, but samples from the Control Examples 1 and 2 showed much less shiness, which could not reach the level of gloss exceeding that of art paper.

Therefore, it is clear from the comparison of the Examples and Control Examples that the combination of the polymer latex having a high Tg and satin white produces unexpected and conspicuous advantages.

EXAMPLE 4 and CONTROL EXAMPLES 3 and 4

The coating colors containing 60% by weight of solid as shown in TABLE 3 were applied in the same manner as in Examples 1–3.

The gloss and ink absorption of the resulting coated paper are shown in TABLE 4. Examples 4 showed uniform and high shiness, and good ink absorption, but in control example 3, the coated layer sticked to the heated calender and, therefore, continuous operation was impossible. The resulting coated paper was defective in ink absorption and, therefore, it is improper as printing paper. The coated paper obtained in this Example was poor in the 20° reflectisn gloss or so-called shiness.

TABLE 1

| | EXAMPLES | | | CONTROL EXAMPLES | |
|---|---|---|---|---|---|
| | 1 | 2 | 3 | 1 | 2 |
| Kaolin | 85 | 85 | 85 | 85 | 100 |
| Satin White | 15 | 15 | 15 | 15 | |
| Styrene-Butadiene Latex (Tg = 55° C.) | 28 | | | | 28 |
| Styrene-Isoprene Emulsion (Tg = 50° C.) | | 28 | | | |
| Acrylic Polymer Emulsion (Tg = 68° C.) | | | 28 | | |
| Styrene-Butadiene Latex (Tg = 18° C.) | | | | 28 | |
| Oxidized Starch | 1 | 1 | 1 | 1 | 1 |
| Oxidized Polyethylene Emulsion | 2 | 2 | 2 | 2 | 2 |
| Sodium Alginate | 0.5 | 0.5 | 0.5 | 0.5 | 0.5 |

The numerals in TABLE I are expressed with parts by weight of solids.

TABLE 2

| (Angle to Normal of Coated Paper Surface) | Reflection Gloss | | | | |
|---|---|---|---|---|---|
| | EXAMPLES | | | CONTROL EXAMPLES | |
| | 1 | 2 | 3 | 1 | 2 |
| 75° | 86 | 84 | 88 | 78 | 86 |
| 60° | 69 | 65 | 69 | 43 | 48 |
| 45° | 55 | 50 | 57 | 22 | 29 |

TABLE 2-continued

| (Angle to Normal of Coated Paper Surface) | Reflection Gloss | | | | |
|---|---|---|---|---|---|
| | EXAMPLES | | | CONTROL EXAMPLES | |
| | 1 | 2 | 3 | 1 | 2 |
| 20° | 35 | 33 | 37 | 11 | 14 |

TABLE 3

| | EXAMPLE | CONTROL EXAMPLES | |
|---|---|---|---|
| | 4 | 3 | 4 |
| Kaolin | 80 | 80 | 40 |
| Plastic Pigment | 10 | 10 | 10 |
| Satin White | 10 | 10 | 50 |
| Styrene-Butadiene Latex (Tg = 55° C.) | 12 | 50 | 12 |
| Oxidized Starch | 1 | 1 | 1 |
| Oxidized Polyethylene Emulsion | 2 | 2 | 2 |
| Sodium Alginate | 0.4 | 0.4 | 0.4 |

TABLE R

| (Angle to Normal of Coated Paper Surface) | Reflection Gloss | | |
|---|---|---|---|
| | EXAMPLE | CONTROL EXAMPLES | |
| | 4 | 3 | 4 |
| 75° | 80 | 90 | 70 |
| 60° | 56 | 68 | 28 |
| 45° | 35 | 52 | 19 |
| 20° | 22 | 32 | 6 |
| Ink Setting | 78 | 52 | 78 |

What is claimed is:

1. A process for producing a high gloss coated paper comprising applying to paper an aqueous coating color containing 5 to 40 parts by weight of satin white per 100 parts by weight of total pigments and 5 to 40 parts by weight of a polymer latex having a Tg more than 45° C. per 100 parts by weight of total pigments, drying and subjecting the dried, coated substrate to specular finishing at a temperature higher than Tg of the polymer latex.

2. The process according to claim 1 wherein the amount of the satin white is in the range of 10–20 parts by weight per 100 parts by weight of the total pigments.

3. The process according to claim 1, wherein the polymer latex is a polyvinyl acetate latex, styrene-isoprene copolymer latex, styrene-butadiene latex or acrylic polymer latex.

4. The process according to claim 1, wherein the amount of the polymer latex is in the range of 15–30 parts by weight per 100 parts by weight of the total pigment.

5. The process according to claim 1, wherein the specular finishing is carried out at a temperature ranging from 100° to 200° C.

6. The process according to claim 1, wherein the specular finishing is carried out at a temperature higher than the Tg of the polymer latex by 30°–130° C.

7. The process according to claim 1, wherein the specular finishing is carried out under a linear pressure of 40 to 190 kg/cm.

8. The process according to claim 1, wherein the the amount of the coating color applied onto one side of paper is in the range of 5 to 40 grs/m$^2$.

9. A high gloss coated paper produced by the process according to claim 1.

10. A process according to claim 1 wherein the amount of satin white is in the range of 10–20 parts by weight per 100 parts by weight of the total pigment, the polymer latex is a polyvinyl acetate latex, styrene-isoprene copolymer latex, styrene-butadiene latex or acrylic polymer latex, the amount of the polymer latex is in the range of 15–30 parts by weight per 100 parts by weight of the total pigment, the specular finishing is carried out at a temperature ranging from 100° to 200° C. and higher than the Tg of the polymer latex by 30°–130° C., the specular finishing is carried out under a linear pressure of 40 to 190 kg/cm and the amount of the coating color applied onto one side of the paper is in the range of 5 to 40 grams/$m^2$.

11. A process according to claim 10 wherein the coated paper has a gloss at 20° of at least 15%.

12. A process according to claim 1 wherein the coated paper has a gloss at 20° of at least 15%.

13. A high gloss coated paper produced by the process according to claim 10 having a gloss at 20° of at least 15%.

14. A high gloss coated paper produced by the process according to claim 1 having a gloss at 20° of at least 15%.

* * * * *